United States Patent [19]

Häger

[11] 4,377,039

[45] Mar. 22, 1983

[54] PROCESS FOR THE DRYING OF WOOD BY USE OF DIELECTRIC ENERGY

[76] Inventor: Bror O. Häger, Forsetevagen 5, S-182 63 Djursholm, Sweden

[21] Appl. No.: 286,675

[22] Filed: Jul. 24, 1981

[51] Int. Cl.[3] ..... F27B 3/34; F27B 3/00; F27B 5/04

[52] U.S. Cl. ..... 34/1; 34/9.5; 34/16.5

[58] Field of Search ..... 34/1, 4, 9.5, 13.4, 34/13.8, 16.5, 17

[56] References Cited

U.S. PATENT DOCUMENTS

| | | | |
|---|---|---|---|
| 1,007,513 | 10/1911 | Alcock | 34/9.5 |
| 3,721,013 | 3/1973 | Miller | 34/1 |
| 3,811,200 | 5/1974 | Hager | 34/16.5 |

*Primary Examiner*—John J. Camby

*Attorney, Agent, or Firm*—Burns, Doane, Swecker & Mathis

[57] ABSTRACT

A process for the drying of wood is disclosed. The drying is carried out by heating the wood in an oil and under vacuum with heating being carried out wholly or partly by use of dielectric energy.

18 Claims, No Drawings

PROCESS FOR THE DRYING OF WOOD BY USE OF DIELECTRIC ENERGY

BACKGROUND OF THE INVENTION

The present invention is directed to an improved process for the drying of wood.

It is known that a rapid and mild drying of wood can be carried out in warm oil under vacuum. Many processes are known for the drying of wood. For example, U.S. Pat. No. 3,560,251 (issued to Hager) discloses the preservation of wood with aqueous solutions followed by drying/coloring of the wood in a heated high-boiling oil under vacuum. U.S. Pat. No. 3,995,077 (issued to Hager) discloses a process where the wood is impregnated with preservation agents contained in an organic solvent followed by the drying/coloring of the wood in hot oil with simultaneous recovery of solvent. U.S. Patent application Ser. No. 125,774 (of Hager) discloses wood preservation with an emulsion followed by drying/coloring of the wood in hot oil. In addition, U.S. Pat. No. 3,811,200 (issued to Hager) discloses a process wherein wet (green) wood is dried in a low boiling oil.

However, it can be a disadvanage for significant amounts of the drying oil to remain in the surface layer of the wood subsequent to the drying process. If too much drying oil remains in the wood, costs are increased as well as the risk of fire and environmental problems. In addition, difficulties can occur with respect to the painting of the wood or use of glue therewith.

In order to overcome these problems, drying oils have been chosen for use with such processes having specific boiling points with the process being carried out at suitable vaccum and temperature. Furthermore, the process can be performed in separate operations to facilitate evaporation of the drying medium from the wood surface.

It is desirable, however, to provide a process for the drying of wood which permits contact of the wood with the drying oil to be minimized and which more effectively removes moisture from the inner portions of the wood.

OBJECTS AND SUMMARY OF THE INVENTION

It is thus an object of the present invention to provide an improved process for the drying of wood.

It is also an object of the present invention to provide a process for the drying of wood wherein the amount of drying oil which remains in the wood is minimized.

It is also an object of the present invention to provide a drying process which more easily removes moisture from the inner portions of wood.

It is further an object of the present invention to overcome the disadvantages of the prior art discussed above.

In accordance with the present invention, there is thus provided a process for the drying of wood wherein the wood is contacted with a warm drying oil maintained under reduced pressure, with at least a portion of the heat necessary to dry the wood being generated by dielectric energy. The wood may be heated by means of the dielectric energy either while in contact with the drying oil or subsequent to removal of the wood from contact with the drying oil.

DETAILED DESCRIPTION OF THE INVENTION

It has been discovered that wood drying processes with oil under a vacuum can be advantageously combined with a dielectric drying process. Dielectric drying processes have the advantage that the heat can be generated within the wood at the location where it is needed. Thus, the heat does not, as is the case with conventional convection heating, move slowly from the outer surface to the inner portions of the wood in order to be utilized for the evaporation of moisture.

Such heat can be provided by dielectric means within a varied frequency range. For various reasons, only two frequency ranges are generally of interest. The higher frequency range lies in the GHz region (about 1000 million cycles per second). The lower frequency range (usually called high-frequency) lies in a region of about tens of MHz (million cycles per second). The energy sources for the frequency in the GHz region generally are denoted as microwave generators. The energy sources within the lower frequency range are denoted as HF- or high-frequency-generators. Such sources of dielectric energy are well-known to those skilled in the art.

The notation EDA hereinafter is used to denote a heating/drying process that occurs within the higher frequency range, preferably the GHz region, with the notation EDB being used for a heating/drying process that occurs within the lower frequency range, preferably the region of some tens of MHz. The given limits are not all inclusive as some fluctuation will occur depending on different methods of construction of the apparatus and other circumstances.

An electrically sealed chamber or cavity is employed when an EDA process is used with wave guides as connections to the microwave generator. Capacitive field activators with related electrodes and connecting wires are employed when an EDB process is used. As previously noted, such apparatus is conventional and known to those skilled in the art.

The use of EDA is preferred but the use of EDB may also be advantageous under certain circumstances. The disadvantage with respect to EDB is that the wood to be dried must be positioned between electrodes so that the drying process can be more difficult to accomplish and/or result in a loss in wood drying capacity.

In the drying process of the present invention, the heat which is necessary to dry the wood may be supplied wholly or partly by the dielectric energy source. Such energy is, however, rather expensive and a combination of the conventional convection drying process (where the heat is provided by conventional non-dielectric energy means) in combination with the use of the above-noted dielectric energy may provide the best result. In such an embodiment, the drying process is initiated in a conventional manner by contacting the wood with a drying oil so as to evaporate a major portion of the moisture from the wood. For example, up to about 80 percent by weight of the moisture present in the wood is desirably evaporated therefrom prior to application of heat derived from the dielectric energy source.

During such contacting with a drying oil, a portion of the drying oil together with any additives (e.g., coloring pigments) contained therein penetrates the surface layer of the wood. At the same time and as a result of the temperatures and pressures employed, a portion of the moisture or solvent originally present in the wood evaporates from the wood.

For the purposes of the present invention, the drying oil may be either a low or high boiling oil or mixture thereof. Suitable low boiling oils possess boiling points ranging from about 150° to about 250° C. and preferably between about 175° and about 200° C. These oils are, of course, not miscible with water.

Such low boiling oils are preferably comprised of petroleum products having a low content of aromatic compounds in order to avoid the leaching out of resins and other materials from the wood. Exemplary low boiling oils include but are not limited to a petroleum product marketed under the tradename "Shellsol T" which boils between about 187° C. and 212° C., has a flash point of 55° C., and is free of aromatics. See also U.S. Pat. No. 3,811,200, herein incorporated by reference, for further discussion of low boiling/oils suitable for use in the present invention.

Suitable high boiling oils possess boiling points ranging from about 300° C. to about 400° C., and preferably in excess of about 350° C. The use of low boiling drying oils is preferred in order to enable as much of the drying oil as possible to be removed from the wood by evaporation subsequent to the drying step.

The drying oil may contain various additives in order to impart desirable characteristics to the wood during the contacting step. For example, the addition of waxes or resins will serve to impart water repellancy to the wood. The use of conventional fire-protective substances such as chloroparaffin can also be desirably dissolved in the oil mixture. Suitable pigmenting or coloring substances can be introduced into the oil to ensure that the wood will become colored during the course of the drying step. Such additives are conventional and well-known to those skilled in the art.

If coloring pigments are employed, it is preferred that high boiling oils be employed to ensure that the pigments are adequately dispersed. Stirring facilitates, however, the dispersion of the pigments within the oil. If the intention is to obtain an oil treatment of the wood surface without coloring, low boiling or high boiling oils can be successfully employed. Even if it, in these cases, is more difficult to introduce pigments in low boiling oils, it is still possible to introduce dissolved substances such as wax, and preservatives against decay, blue stain, mould and insects, etc.

The method of operation and conditions of temperature and pressure which can be employed during the drying/coloring step are readily determined by one skilled in the art. For example, the wood to be treated is placed in a treatment cylinder adapted to be closed to the atmosphere. The wood is then contacted with a suitable drying oil heated to a suitable temperature. For example, the drying oil is generally heated from about 60° to about 90° C., and preferably heated to about 80° C.

In addition, a vacuum is maintained within the treatment cylinder to facilitate removal of moisture or solvents from the wood so as to avoid the need to employ high temperatures in the treatment cylinder. Water and/or solvents which evaporate or boil off are recovered and subjected to condensation to separate the components of the mixture which is recovered. The drying oil may then be recycled.

The vacuum should desirably be sufficiently high to enable the water to boil off energetically but not so high that such boiling occurs too rapidly. The higher the overall boiling point of the drying oil mixture employed, the higher the vacuum employed can be. A suitable vacuum will generally range from about 20 to about 120 mm Hg.

Dielectric energy may be employed to heat the wood from the inception of the contact of the wood with the drying oil. It is desirable, however, to withhold use of the dielectric energy until the outer and more voluminous portions of the wood have been substantially dried in the above-described manner such that the inner portions of the wood still contain substantial amounts of moisture. The object is to then remove the remaining portion of the water present in the wood by use of dielectric energy. The evaporation of the moisture which remains in the inner portion of the wood represents the most difficult step of the drying process. The dielectric energy is desirably focused upon this moisture region within the wood and represents therefore an excellent method by which to complete the drying process.

An additional reason for use of such a two step as opposed to single step drying process is that the heat which is generated by the dielectric energy can generally only penetrate a relatively short distance into wood which contains significant amounts of moisture. Such energy thus may not be very effective in drying the inner portion of the wood since the moisture in the outer portion can serve, in effect, as an energy screen.

An additional embodiment of the two step process may also be practiced. That is, when the moisture content of the wood has been decreased to the desired extent by contact with the drying oil, the oil can be removed from contact with the wood with the wood being maintained under reduced pressure. The wood is maintained under a vacuum to cause any oil which remains to evaporate from the wood. Dielectric energy can then be employed to further decrease the moisture content of the wood to the desired amount. The dried wood may then be recovered from the drying zone.

There are further advantages to be attained by combining a conventional drying process with dielectric heating. The drying medium preferably possesses suitable physical properties such that the heat provided by the electrical energy is very little imparted to the drying medium. If a part of the heat should be transferred to the drying medium, its effectiveness is decreased with respect to heating of the wood although less heat from other sources may be required to warm the drying medium in the long run.

In order to achieve maximum effectiveness of the use of dielectric energy, the wood is enclosed in a metallic cavity which forms a suitable enclosure for the dielectric energy for heating. The cavity may take many forms. Very often the main portion of the cavity is constructed of an iron cylinder and is further improved by covering the inside of the cylinder with a suitable metal such as copper or aluminum. Ionization effects and arcing are more easily kept under control by use of a vacuum in the cylinder.

When the last step of the drying process is carried out by use of heat derived from dielectric energy, it is also possible to solve the most difficult problem in connection with conventional drying processes, i.e., the removal of the remainder of the drying medium from the surface of the wood. This means also that the steps for the performance of the conventional drying step can be simplified. For example, it is not necessary to require the use of a high quality drying medium. By example, a medium having a somewhat higher boiling point (up to 30° C. higher than that disclosed in U.S. Pat. No. 3,811,200) can be employed which facilitates the drying operation.

It has been described above how dielectric energy can be employed in the later stage of the drying process. The dielectric energy can, however, be employed earlier in the drying process. In this embodiment, the drying occurs initially in a manner comparatively similar to conventional drying processes and without significant effect upon the inner portions of the wood. The process gradually changes character and the heat generated by the dielectric energy eventually becomes more concentrated within the inner portion of the wood as the outer portions of the wood are dried. Such heating would in such a process be relatively expensive. However, some savings are obtained since no conventional convection heating unit is required.

When the heating is carried out by use of dielectric energy with a drying medium in the cylinder, a higher temperature is eventually obtained in the inner portion of the wood as opposed to the temperature of the outer portions and the drying medium. In this situation, it is possible to condense steam which evaporates from the wood in the drying oil. The oil is subsequently heated as a result of heat of condensation being imparted to the oil from the condensing steam. The condensed water may be separated from the drying medium in the drying cylinder due to the density differences thereof. When the moisture content of the wood has been decreased sufficiently, the oil is removed from contact with the wood and the wood maintained under vacuum to permit residual oil to evaporate. The wood may thereafter be recovered from the drying zone.

The process of the present invention may be used to dry/color several types of wood. That is, the wood may have been pretreated with a preservative solution (e.g., an aqueous preservative solution or an organic solvent-containing preservative solution). After the preservative solution has contacted the wood for a sufficient period of time, it is removed from the wood and subsequently contacted with a drying/coloring oil mixture to remove the water or solvent from the wood and possibly also color the wood by the method of the present invention.

In addition, wood which has not been treated with a preservative solution but which it is desired to remove moisture from (e.g., green or wet wood) can be dried by contact with the oil mixture by the method of the present invention. The wood is contacted with the oil mixture under suitable conditions of temperature and pressure to cause the moisture present in the wood to evaporate from the wood.

Exemplary processes wherein either wet or green wood or wood which has been pretreated with a preservative solution have been dried and/or colored by contact with an oil mixture are described in U.S. Pat. Nos. 3,811,200 and 3,560,251, each herein incorporated by reference.

The principles, preferred embodiments and modes of operation of the present invention have been described in the foregoing specification. The invention which is intended to be protected herein, however, is not to be construed as being limited to the particular forms disclosed, since these are to be regarded as illustrative rather than restrictive. Variations and changes may be made by those skilled in the art without departing from the spirit of the invention.

I claim:

1. A method for the drying of wood which comprises heating wood to be dried in a closed container under reduced pressure in a drying oil, said wood being at least partially heated by means of dielectric energy and said pressure being reduced sufficiently to cause moisture present in the wood to be removed therefrom, thereafter removing said drying oil from contact with the wood upon removal of the desired amoung of moisture from the wood while maintaining the wood under reduced pressure to permit residual oil and moisture to evaporate therefrom, and recovering said wood.

2. The method of claim 1 wherein said drying oil boils from about 150° to about 250° C.

3. The method of claim 1 wherein said drying oil is heated to a temperature of between about 60° to 90° C.

4. The method of claim 1 wherein said drying oil boils below about 200° C.

5. The method of claim 1 wherein said dielectric energy is provided by a microwave generator.

6. The method of claim 1 wherein said dielectric energy is provided by a high-frequency generator.

7. The method of claim 1 wherein said reduced pressure ranges from about 20 to about 120 mm Hg.

8. The method of claim 1 wherein said dielectric energy is employed to heat the wood after at least a major portion of the moisture is removed from the wood as a result of contact thereof with said drying oil under reduced pressure.

9. The method of claim 8 wherein said at least major portion comprises at least about 80 percent by weight of said moisture.

10. A method for the drying of wood which comprises heating wood to be dried in a closed container under reduced pressure in a heated drying oil, said wood being heated and said pressure being reduced sufficiently to cause moisture present in the wood to be removed therefrom, removing the wood having a reduced moisture content from contact with the dying oil while maintaining the wood under reduced pressure, further heating the wood to remove additional moisture therefrom by use of dielectric energy, and thereafter recovering said wood.

11. The method of claim 10 wherein said drying oil boils from about 150° to 250° C.

12. The method of claim 10 wherein said drying oil is heated to a temperature of between about 60° and 90° C.

13. The method of claim 10 wherein said drying oil boils below about 200° C.

14. The method of claim 10 wherein said dielectric energy is provided by a microwave generator.

15. The method of claim 10 wherein said dielectric energy is provided by a high-frequency generator.

16. The method of claim 10 wherein said reduced pressure ranges from about 20 to about 120 mm Hg.

17. The method of claim 10 wherein said dielectric means is employed to heat the wood after at least a major portion of the moisture is removed from the wood as a result of contact thereof with said heated drying oil under reduced pressure.

18. The method of claim 17 wherein said at least major portion comprises at least about 80 percent by weight of said moisture.

* * * * *